United States Patent [19]

Takayama

[11] Patent Number: 4,849,705

[45] Date of Patent: Jul. 18, 1989

[54] METHOD OF INCIDENCE OF CHARGED PARTICLES INTO A MAGNETIC RESONANCE TYPE ACCELERATOR AND A MAGNETIC RESONANCE TYPE ACCELERATOR IN WHICH THIS METHOD OF INCIDENCE IS EMPLOYED

[75] Inventor: Takeshi Takayama, Tokyo, Japan

[73] Assignee: Sumitomo Heavy Industries, Ltd., Tokyo, Japan

[21] Appl. No.: 60,868

[22] PCT Filed: Sep. 22, 1986

[86] PCT No.: PCT/JP86/00491

§ 371 Date: May 20, 1987

§ 102(e) Date: May 20, 1987

[87] PCT Pub. No.: WO87/01900

PCT Pub. Date: Mar. 26, 1987

[30] Foreign Application Priority Data

Sep. 21, 1985 [JP] Japan ..... 60-207791
Mar. 29, 1986 [JP] Japan ..... 61-69775

[51] Int. Cl.[4] ..... H05H 13/04

[52] U.S. Cl. ..... 328/233; 328/228; 328/230; 328/235; 328/237

[58] Field of Search ..... 328/233, 235, 228, 237, 328/230; 313/62

[56] References Cited

U.S. PATENT DOCUMENTS 3,831,121 8/1974 Oster ..... 328/228 X
3,935,503 1/1976 Ress ..... 328/233
4,481,475 11/1984 Kapetanakos ..... 328/237

FOREIGN PATENT DOCUMENTS 312400 10/1971 U.S.S.R. ..... 328/233

OTHER PUBLICATIONS

Tomimasu et al., "A600-MeV ETL Electron Storage Ring," IEEE Transactions on Nuclear Science, vol. NS-30, No. 4, Aug. 1983, pp. 3133-3135.

*Primary Examiner*—Donald J. Yusko
*Assistant Examiner*—Michael Horabik
*Attorney, Agent, or Firm*—Burns, Doane, Swecker & Mathis

[57] ABSTRACT

Upon injecting charged particles onto a central equilibrium orbit formed within a magnetic resonance type accelerator, a resonant orbit whose horizontal betatron oscillation member is ½ for the charged particles, is formed, and this resonant orbit is varied in time. By varying the above-mentioned resonant orbit in time, it becomes easy to inject charged particles having high energy onto a central equilibrium orbit, and a magnetic resonance type accelerator can be reduced in size. In order to form above-described resonant orbit whose horizontal betatron oscillation number is ½, a non-linear magnetic field employing a octa-pole magnetic field as an auxiliary converging component is applied to a central equilibrium orbit plane by a first electro-magnet, and in order to vary the resonant orbit in time, a magnetic field including a quadrupole magnetic field as a principal component is applied by a second electro-magnet, and this magnetic field may be varied in time. Alternatively, a principal magnetic field is applied to a central equilibrium orbit plane by a first electro-magnet, a non-linear magnetic field including an octa-pole magnetic field as a principal converging component is applied to the central equilibrium orbit plane by a second electro-magnet, thereby a resonant orbit whose horizontal betatron oscillation number is ½ is formed, and the resonant orbit may be varied in time by varying the octa-pole magnetic field in time.

4 Claims, 6 Drawing Sheets

METHOD OF INCIDENCE OF CHARGED PARTICLES INTO A MAGNETIC RESONANCE TYPE ACCELERATOR AND A MAGNETIC RESONANCE TYPE ACCELERATOR IN WHICH THIS METHOD OF INCIDENCE IS EMPLOYED

TECHNICAL FIELD

The present invention relates to a magnetic resonance type accelerator having a revolving orbit including a central equilibrium orbit such as a synchrotron, an accumulation ring, a collision ring or the like, and more particularly to a method of incidence for injecting charged particles into a magnetic resonance type accelerator and a magnetic resonance type accelerator making use of this method of incidence.

BACKGROUND TECHNIQUE

Heretofore, a magnetic resonance type accelerator having a revolving orbit such as a synchrotron or the like has been known, and in recent years an SOR apparatus making use of this synchrotron has been proposed as a light source of an X-ray exposure apparatus for use in micro-fine machining of super LSI's.

In such a magnetic resonance type accelerator is provided an electro-magnet for displacing an equilibrium orbit that is called "perturbator" (or "kicker") and an inflector for guiding charged particles to a revolving orbit by generating a magnetic field or an electric field in a D.C. fashion.

In the case of the magnetic resonance type accelerator in the prior art, deflecting elements and converging elements have been disposed at a plurality of locations on the equilibrium orbit, and the charged particles guided to an incidence orbit by the inflector would enter the equilibrium orbit displaced by the above-mentioned perturbator. Thereafter, the above-described displaced equilibrium orbit is returned to its original location by weakening the magnetic field generated by the perturbator, and then incidence of the charged particles is completed.

However, in the case where an SOR apparatus is employed as a light source of an X-ray exposure apparatus, it is necessary to provide a small magnetic resonance type accelerator. But in order to reduce the size of a magnetic resonance type accelerator and inject charged particles with high energy, an electro-magnet such as a perturbator or the like which can generate a magnetic field varying at an extremely high speed and having a high intensity, becomes necessary. However, the intensity and response speed of a magnetic field that can be realized by means of an electro-magnet are limited, and so it is difficult to reduce the size of a magnetic resonance type accelerator.

On the other hand, in the case where charged particles are injected, accumulated and accelerated with an extremely weak magnetic field, the life of the accumulated charged particles is short, and hence, it is impossible to accumulate a sufficient amount of charged particles.

Accordingly, an object of the present invention is to provide a method of incidence of charged particles and an apparatus for practicing the method, which are simple, and in which a perturbator is not necessitated to generate a magnetic field of high intensity varying at a high speed.

DISCLOSURE OF THE INVENTION

According to the present invention, there is provided a method of incidence of charged particles onto a central equilibrium orbit in a magnetic resonance type accelerator in which revolving orbits including the central equilibrium orbit are defined, which method includes the step of forming a resonant orbit whose horizontal betatron oscillation number for these charged particles becomes $\frac{1}{2}$, and varying this resonant orbit in time to inject the charged particles onto the central equilibrium orbit.

As a magnetic resonance type accelerator to which the above-mentioned method of incidence is applied, there is provided a magnetic resonance type accelerator comprising an inflector for guiding charged particles onto an incidence orbit, a first electro-magnet for generating a non-linear magnetic field employing an octa-pole magnetic field as a converging component in superposition on a principal magnetic field applied to revolving orbits to form a resonant orbit whose horizontal betatron oscillation number becomes $\frac{1}{2}$in that non-linear magnetic field, and a second electro-magnet for generating a magnetic field including a quadrupole magnetic field as a principal component and varying in time to vary the resonance orbit in time. Furthermore, there is provided a magnetic resonance type accelerator comprising an inflector for guiding charged particles onto an incident orbit, a first electro-magnet for applying a principal magnetic field to revolving orbits, and a second electro-magnet for generating a non-linear magnetic field employing an octa-pole magnetic field as a principal converging component to form a resonant orbit whose horizontal betatron oscillation number becomes $\frac{1}{2}$ in that non-linear magnetic field, in which the resonant orbit is varied in time by varying the octa-pole magnetic field in time.

THE BEST MODE FOR EMBODYING THE INVENTION

At first, in order to facilitate understanding of the present invention, description will be made on a magnetic resonance type accelerator with reference to FIGS. 1 to 4.

Figure 1:
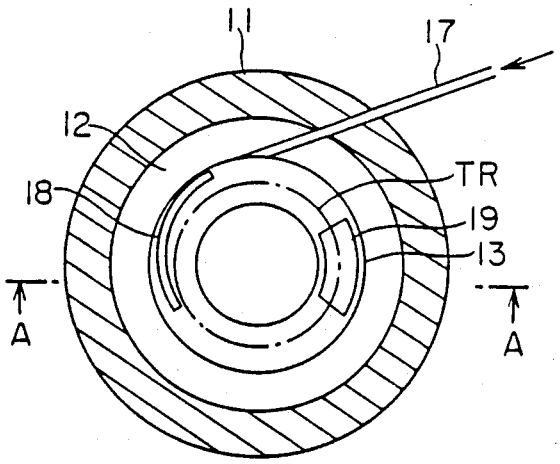
FIG. 1 is a plan cross-section view showing a magnetic resonance type accelerator to which the present invention is applicable.
Figure 2:
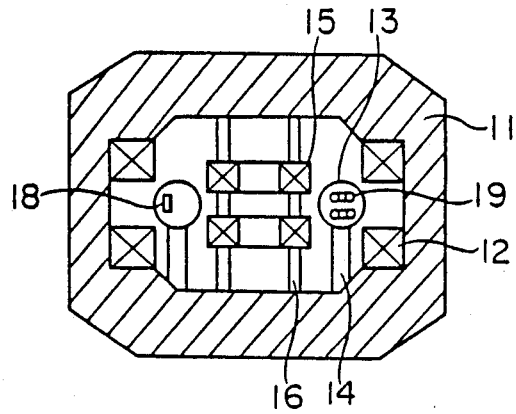
FIG. 2 is a cross-section view taken along line A—A in FIG. 1.

In FIGS. 1 and 2 is shown a magnetic resonance type accelerator. The illustrated magnetic resonance type accelerator includes an iron core 11 which defines a hollow space inside thereof, and a pair of coils 12 are disposed along the inner wall of this iron core 11. Within the hollow space is located a toroidal vacuum duct 13, and this vacuum duct 13 is supported by support stands 14 and held in a vacuum state. Furthermore, in an internal space surrounded by the vacuum duct 13 are disposed another pair of coils 15, and these coils 15 are supported by support stands 16. Here, within the vacuum duct 13 are formed revolving orbits including an equilibrium orbit TR, and the electro-magnet formed by the coils 12 and 15 generates a principal magnetic field in the direction perpendicular to the plane defined by the equilibrium orbit TR.

On the other hand, within the vacuum duct 13 is disposed an inflector 18 which guides charged particles accelerated by an injector (not shown) and shot through an incident beam line 17, onto the revolving orbits. In addition, within the vacuum duct 13 is disposed a perturbator 19 for displacing the equilibrium orbit TR. This perturbator 19 mainly generates a dipole magnetic field.

Figure 3:
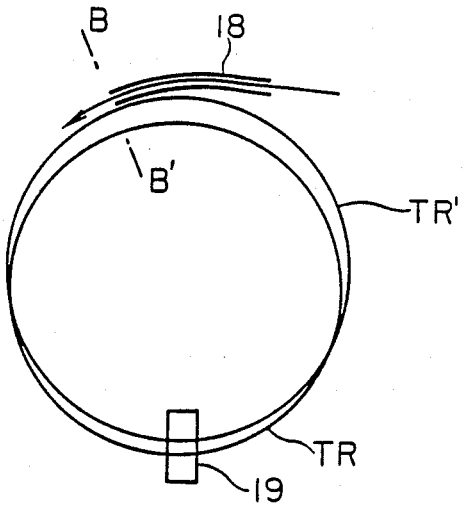
FIGS. 3 and 4 are a schematic view and an diagram for explaining an incidence operation in the magnetic resonance type accelerator shown in FIG. 1.

More particularly, as shown in FIG. 3, the perturbator 19 displaces the equilibrium orbit TR and provides a displaced equilibrium orbit TR'. And, while charged particles (beam) are being introduced from the inflector 18 into this displaced equilibrium orbit TR', the magnetic field of the perturbator 19 is weakened to gradually return the displaced equilibrium orbit TR' to the original equilibrium orbit TR, and then incidence of charged particles is completed.

Figure 4:
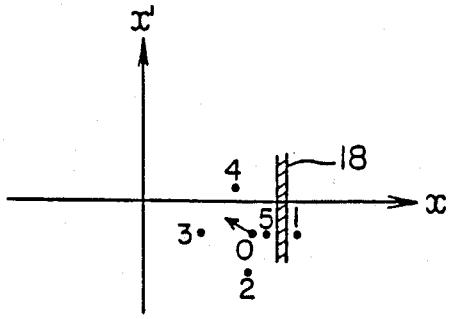

Here, the incidence mechanism will be explained in detail with reference to FIG. 4. FIG. 4 is a phase diagram of the motion in the radial direction on line B—B' in FIG. 3. It is to be noted that betatron oscillations in which an original state is restored after four revolutions are considered here.

In FIG. 4, x represents a displacement in the horizontal direction from the original equilibrium orbit TR, and x' represents an inclination of the equilibrium orbit TR. Furthermore, reference numeral 0 designates a displaced equilibrium orbit TR' displaced by the perturbator 19, numeral 1 designates an incidence orbit, and numeral 2 designates an orbit after a charged particle has been injected and has made one revolution along the revolving orbit. Since the orbit 2 makes betatron oscillation about the equilibrium orbit 0, the orbit is located at the position where the equilibrium orbit 0 has revolved about the equilibrium orbit by an angle determined by the betatron oscillation. Reference numerals 3, 4 and 5 designate orbits after 2, 3 and 4 revolutions, respectively, have made after incidence. The reason why the orbit 5 does not come to the position of the incidence orbit 1, is because the displaced equilibrium orbit 0 moves in the direction of an arrow as the perturbator 19 is weakened. It is a condition for the charged particles not to collide the inflector 18 that the gap between the incidence orbit 1 and the orbit 5 is sufficiently large.

A first preferred embodiment of the present invention will be described with reference to FIG. 5. It is to be noted that in this preferred embodiment, only an incident beam line 17, an inflector 18, a perturbator 19 and an equilibrium orbit TR are illustrated and the other elements shown in FIG. 1 are omitted.

In the first preferred embodiment, a non-linear magnetic field employing octa-pole magnetic field as a converging component is generated on the plane defined by the equilibrium orbit TR by the electro-magnet constructed of the coils 12 and 15 in FIG. 1. On the other hand, the perturbator 19 generates a magnetic field including a quadrupole magnetic field as a principal component, and this magnetic field is varied in time by controlling the perturbator 19.

Figure 6:
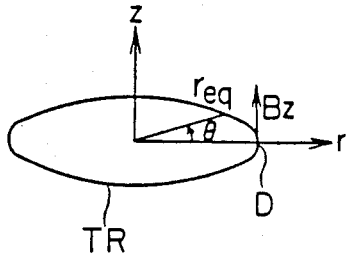
FIG. 6 is a schematic view generally showing an equilibrium orbit.
Figure 7:
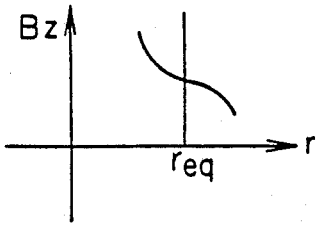
FIG. 7 is a diagram showing a magnetic field distribution on an equilibrium orbit in the first preferred embodiment of the present invention.

Here, if a coordinate system shown in FIG. 6 is set up with respect to the equilibrium orbit TR, then magnetic field distribution on the r-$\theta$ plane is represented by Equations ①.

$$\left.\begin{aligned} B_z(\xi) &= B_{zo}(1 - n\xi + K_2\xi^2 + K_3\xi^3 + \dots) \\ \xi &= (r - r_{eq})/r_{eq} \end{aligned}\right\} \quad ①$$

where $B_{zo}$ represents a magnetic field in the direction of the Z-axis on the central equilibrium orbit TR, and $r_{eq}$ represents a radius of the central equilibrium orbit TR. n represents a parameter for converging the beam, $K_2$, $K_3$, . . . are parameters, and the magnetic field distribution represented by the above equations includes an octa-pole component as shown in FIG. 7.

Figure 8:
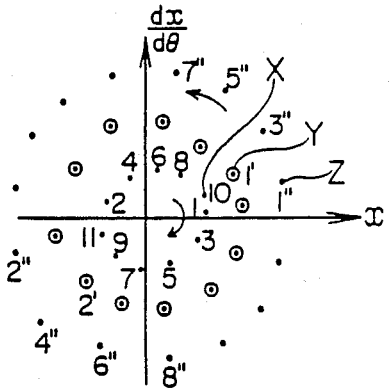
FIG. 8 is a diagram showing phase plots in the radial direction of the equilibrium orbit in the case where a perturbator is not present in the first preferred embodiment.

Now, in FIG. 6 the position of point D is chosen as $\theta=0°$, and an incidence mechanism will be explained with reference to a phase plot diagram of an orbit at this location. In FIG. 8 are shown phase plots of the motion in the r-direction in the case where the perturbator 19 is not present. In FIG. 8, reference character X denotes a plot of an orbit in which an amplitude of a betatron oscillation is small, and in this case, since the betatron oscillation number is larger than $\frac{1}{2}$, the plot rotates in the direction of an arrow in the sequence of the digits in the figure during oscillation. However, if the magnetic field $B_z(\xi)$ includes an octa-pole component as shown in FIG. 7, then as the amplitude of the betatron oscillation becomes large, the betatron oscillation number becomes small. The orbit in the case where the betatron oscillation number is $\frac{1}{2}$ is represented by reference character Y in FIG. 8, and when the betatron oscillation number is $\frac{1}{2}$, the charged particle would only oscillate between the numerals 1' and 2'. If the amplitude of the betatron oscillation increases further, then the betatron oscillation number becomes smaller than $\frac{1}{2}$, the orbit of the charged particle becomes the orbit represented by reference character Z, and the charged particle would revolve in the opposite direction to the case of the orbit X.

Figure 5:
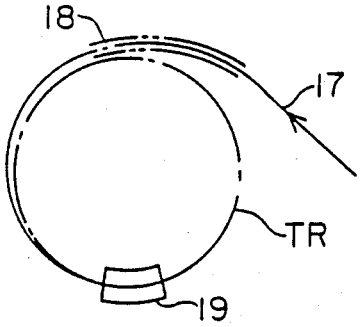
FIG. 5 is a schematic view generally showing a first preferred embodiment of a magnetic resonance type accelerator according to the present invention.
Figure 9:
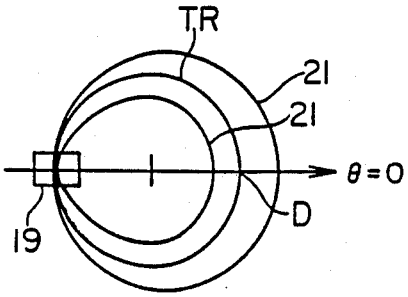
FIGS. 9 and 10 are a schematic view and a diagram showing orbits and phase plots, respectively, for explaining the operation of the first preferred embodiment of the present invention.
Figure 10:
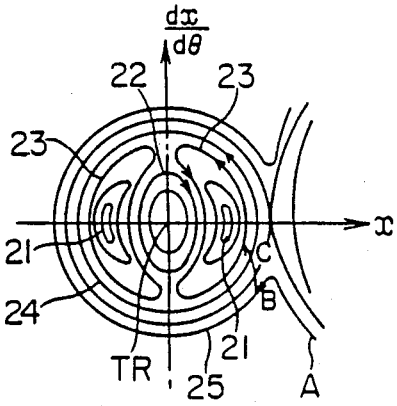

On the other hand, if the perturbator 19 is provided as shown in FIG. 5, then among the orbits Y oscillating between two points, a stable orbit is only the orbit having a node at the position of the perturbator 19 such as an orbit 21 shown in FIG. 9. In the phase plots, as shown in FIG. 10, they are classified into two groups of orbits rotating about an orbit which does not move and orbits outside of a stable region. An orbit 22 belongs to the group of revolving about the central equilibrium orbit TR in the state X shown in FIG. 8. The group of orbits 23 revolves about the orbit 21 while oscillating between the left and right closed regions. An orbit 24 is a group which revolves so as to wrap the orbits 22 and 23 under the state Z in FIG. 8. An orbit 25 belongs to a group which flies away without being captured in the stable region. And the size of the region of the orbit 23 corresponds to the strength of the perturbator 19.

Figure 11:
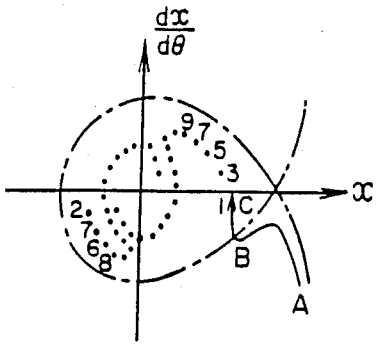
FIG. 11 is a diagram showing phase plots of an incidence orbit only of charged particles in the first preferred embodiment of the present invention.

Referring to FIG. 10, incidence of charged particles is effected from the exterior along the orbit 25 in the direction A. When the charged particle has come to point B, it moves to point C due to the inflector 18. When the charged particle moves along the orbit 23 while oscillating, if the perturbator 19 is weakened as the charged particle approaches the orbit 22, then the charged particle transfers to an orbit in which the charged particle revolves while oscillating about the central equilibrium orbit TR such as the orbit 22. In this way, the orbit captured in the region of the orbit 22 would not be enlarged in amplitude until it comes again at the position of point C, and so it would not collide against the inflector 18. If only the incidence orbit is plotted in phase, it becomes as shown in FIG. 11. It is to be noted that numerals represent times of passing through the point of $\theta=0°$ after incidence.

As described above, in the first preferred embodiment, owing to the fact that a resonant orbit whose betatron oscillation number becomes $\frac{1}{2}$ is formed by a non-linear magnetic field employing an octa-pole magnetic field as an auxiliary converging component and a magnetic field including a quadrupole magnetic field generated by the perturbator 19 as a principal component is varied in time, that is, since an orbit making betatron oscillation about a resonant orbit is utilized for incidence, the loading upon the inflector 19 is mitigated. The strength and the speed of variation in time of the perturbator 19 can be reduced. A beam can be injected into an accumulation ring of a small-sized strong magnetic field. Intervals between the incidence orbit and the revolving orbits after incidence are large, and accordingly an incidence efficiency would be improved.

Now, in the case of the first preferred embodiment, due to the fact that the octa-pole magnetic field remains statically, charged particles such as electrons, positrons or the like would diverge while emitting light, and so improvements in the incidence efficiency would be limited.

Therefore, description will be made on a second preferred embodiment in which improvements in an incidence efficiency were contemplated.

Figure 12:
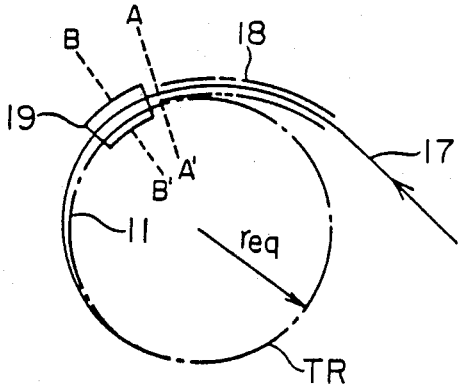
FIG. 12 is a schematic view generally showing a second preferred embodiment of a magnetic resonance type accelerator according to the present invention.

In FIG. 12 is shown a second preferred embodiment of the present invention. It is to be noted that in this preferred embodiment, like the first preferred embodiment only an incident beam line 17, an inflector 18, a perturbator 19 and an equilibrium orbit TR are shown, and the other elements shown in FIG. 1 are omitted.

In the second preferred embodiment, a principal magnetic field is applied from the electromagnets constructed of the coils 12 and 15 shown in FIG. 1 to the plane defined by the equilibrium orbit TR. On the other hand, the perturbator 19 forms a non-linear magnetic field employing an octa-pole magnetic field as a principal converging component, and this non-linear magnetic field is varied in time by controlling the perturbator 19.

Onto the central equilibrium orbit TR is applied a magnetic field $B_{zo}$ perpendicular to the plane of the sheet, as a result, charged particles having high energy are deflected by this magnetic field, and the central equilibrium orbit TR becomes a closed orbit. In addition, the above-mentioned magnetic field has such distribution that the field intensity decreases towards the exterior in the radial direction, and accordingly, a focusing force directed to the central orbit would exert upon the charged particles displaced minutely from the central equilibrium orbit TR.

Figure 13:
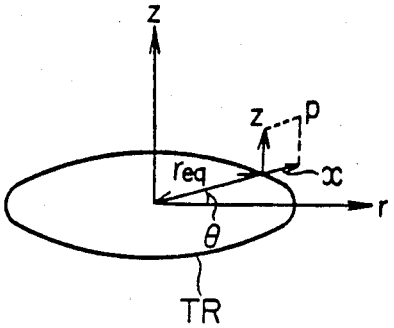
FIG. 13 is a schematic view generally showing an equilibrium orbit.

Here, if a coordinate system is set up as shown in FIG. 13 with respect to the central equilibrium orbit TR, then magnetic field distribution on the r-$\theta$ plane is represented by Equations ① above.

In addition, if the position of a particle as projected on the plane of the central equilibrium orbit is represented by an amount of displacement x in the radially outward direction from the central equilibrium orbit TR and a rotational angle $\theta$ from a reference point (for example, the point A—A′ in FIG. 12) as shown in FIG. 13, then equations of motion for the minute displacement from the central equilibrium orbit TR are represented by Equations ② .

$$\left.\begin{aligned} \frac{d^2x}{d\theta^2} + (1-n)x = 0 \\ \frac{d^2z}{d\theta^2} + nz = 0 \end{aligned}\right\} \quad ②$$

From this it results that in order to converge a beam both in the horizontal direction and in the vertical direction a scope of $0<n<1$ is delimited, and in order that electrons or positrons may not diverge while emitting light, that is, in order that the oscillation may attenuate, a scope of $0<n<0.75$ is delimited.

Here, taking the position of line A—A′ as $\theta=0°$ in FIG. 12, description will be made on the incidence mechanism.

Figure 14:
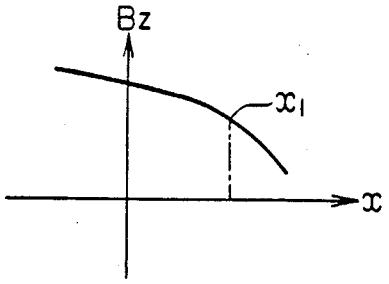
FIG. 14 is a diagram showing a magnetic field distribution on a central equilibrium orbit in the second preferred embodiment of the present invention.
Figure 15:
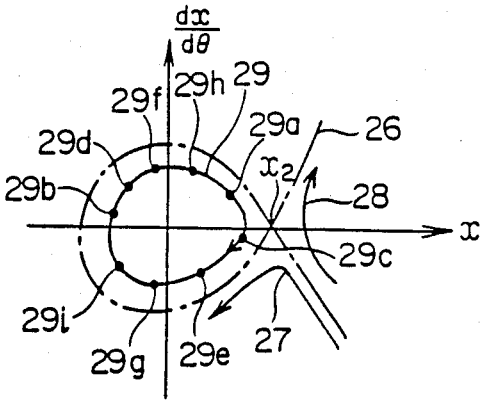
FIG. 15 is a phase diagram of charged particles in the case where an octa-pole magnetic field is not formed in the second preferred embodiment of the present invention.

In the case where charged particles make incidence, as betatron oscillation of large amplitude is effected, magnetic field distribution not only in the proximity of the central equilibrium orbit but also in a wide scope must be considered. Here, the magnetic field distribution on line A—A′ in FIG. 12 is shown in FIG. 14. Point $x_l$ in FIG. 14 is a point corresponding to $n>1$, $B_{zo}\cdot r_{eq}=B_z(x_1)\cdot(r_{eq}+x_1)$. Next, a phase diagram on line A—A′ is shown in FIG. 15. It is to be noted that in FIG. 15 an octa-pole magnetic field is not formed. That is, this figure shows a phase diagram in the x-direction (the radial direction) in the case where the perturbator 19 is not provided. A point corresponding to point $x_l$ in FIG. 14 is designated by $x_2$ in FIG. 15, and this point is an unstable immovable point. And, a stable region and an unstable region are bounded by a separatrix line passing this point $x_2$ and designated by reference numeral 26. Charged particles injected from the outside of the separatrix line 26 would fly away as depicting a locus 27 or 28 without entering the stable region (FIG. 15). In other words, unless the inflector 18 is provided, externally injected charged particles would fly away. The inflector 18 serves to guide an injected charged particle to the inside of the separatrix line 26, i.e., to the stable region, but the charged particle would return again to the position of the inflector 18 depicting a locus 29, and after it collides against the inflector 18, it is lost. (In FIG. 15, the charged particle depicts the locus in the sequence of 29*a*, 29*b*, 29*c*, . . . , 29*i* and returns again to the position of the inflector 18).

Figure 16:
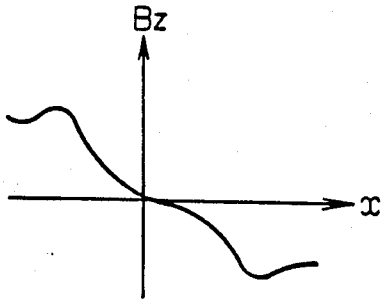
FIG. 16 is a diagram showing a magnetic field distribution in the perturbator used in the second preferred embodiment of the present invention.

On the other hand, in this preferred embodiment, there is provided a perturbator 19 for generating a non-linear magnetic field including an octa-pole magnetic field as a principal component, as shown in FIG. 12. Here, if the real magnetic field distribution of the perturbator 19 is shown as a magnetic field distribution on the orbit plane along the B—B′ line cross-section in FIG. 12, it is as shown in FIG. 16.

Figure 17:
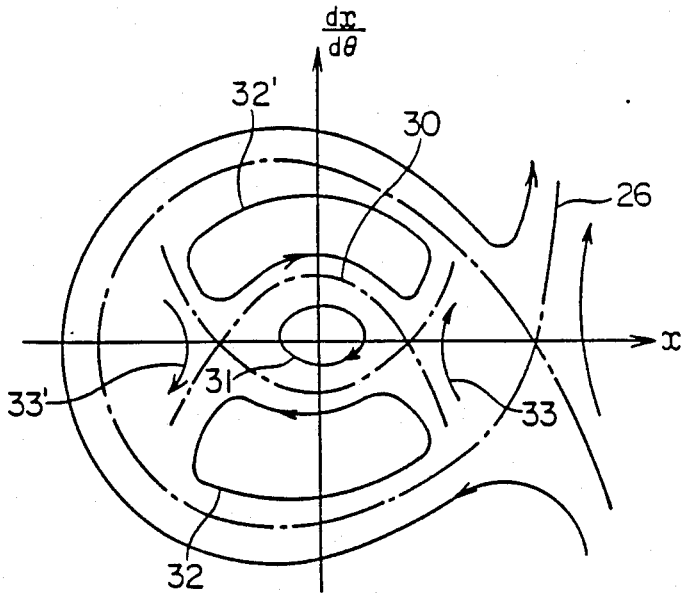
FIGS. 17 and 18 phase diagrams on an equilibrium orbit in the second preferred embodiment of the present invention.

If the perturbator 19 is excited, that is, if the octa-pole magnetic field is generated and a resonant orbit whose horizontal betatron oscillation number is $\frac{1}{2}$ is formed, then a phase diagram on the A—A′ line cross-section in FIG. 12 becomes as shown in FIG. 17 (In FIG. 17, loci are not shown but curves connecting the respective loci are shown.). A separatrix line 30 is formed inside of the separatrix line 26 by the octa-pole magnetic field generated by the perturbator 19. And, a locus of the stable orbits within the separatrix line 30 moves in the direction of an arrow as shown at a reference numeral 31. Also, locus curves outside of the separatrix line 30 are divided into a group represented by 32 and 32′ and a group represented by 33 and 33′. It is to be noted that the locus curves 32 and 32′ and the locus curves 33 and 33′ are formed of such loci which oscillate alternately each time a charged particle makes one revolution within the accelerator, and the respective groups are the same loci.

Figure 18:
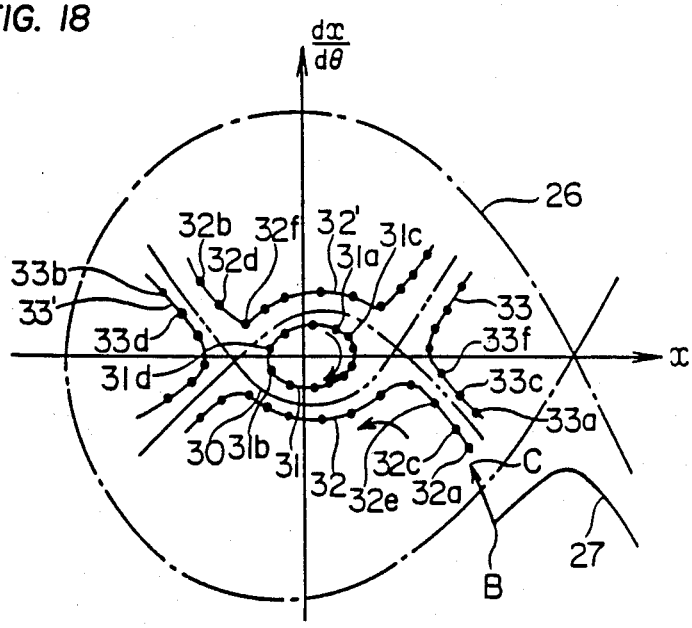

Referring also to FIG. 18, the size of the region of the separatrix line 30 corresponds to the strength of the perturbator 19. Charged particles are injected externally along the orbit 27. When the charged particle has reached point B, it is transferred from the point B to a locus 32*a* (point C) by the inflector 18. On the other hand, if the magnetic field generated by the perturbator 19 is weakened in time, then the region of the separatrix line 30 would become large as described above. The charged particle transferred to the locus 32*a* would approach the separatrix line 30 as it makes betatron oscillation in the sequence of 32*a*, 32*b*, 32*c*, . . . . At this time, since the region of the separatrix line 30 becomes large if the magnetic field generated the perturbator 19 is weakened, the charged particle would be captured inside of the separatrix line 30. In other words, the orbit of the charged particle would become an orbit in which the charged particles revolves while the orbit is oscillating about the central equilibrium orbit as shown by the loci 31*a*, 31*b*, 31*c*, . . . . As described above, since the orbit of the charged particle captured in the region of the separatrix line 30 would not be expanded in size to the position of point 32*a*, the charged particle would not collide against the inflector 18.

Upon the above-mentioned capture of charged particles within the region of the separatrix line 30, the amount of variation of the magnetic field in the perturbator 19 could be little, and accordingly, the speed of variation of the magnetic flux in the perturbator 19 can be made sufficiently slow as compared to the revolving speed of the charged particle along the orbit. In other words, even with a small-sized apparatus, the above-described variation speed can be realized. In addition, since the distance from point B to locus 32*a* in FIG. 18 is extremely short, loading upon the inflector 18 is small, and hence it is also possible to inject a charged particle having high energy.

By the way, after incidence of the charged particle, since the octa-pole magnetic field of the perturbator 19 disappears, the effective value of n of the charged particle captured in the internal region of the separatrix line 30 would become $n<0.75$ as described above. Accordingly, in the case of either electrons or positrons, attenuation of an emittance caused by light emission would occur, and they would not diverge.

As described above, in the second preferred embodiment, since turn separation upon incidence is large, it is possible to improve incidence efficiency, and to inject charged particles having high energy with a high magnetic field. Accordingly, in the case of electrons or positrons, attenuation of an emittance caused by light emission is fast, and so, even if the perturbator is excited again, they would not diverge outside of the stable region.

According to the present invention, since a resonant orbit whose betatron oscillation number is $\frac{1}{2}$ is formed and charged particles are injected to the central equilibrium orbit by varying this resonant orbit in time, even in the case where the magnetic field generates by the perturbator is weak, it is possible to move a charged particle injected with a large amplitude up to the proximity of the central equilibrium orbit. Accordingly, variation in time of the magnetic flux of the perturbator can be made sufficiently slow as compared to the revolving speed of the charged particle, and it becomes possible to inject charged particles to a small-sized magnetic resonance type accelerator in which a revolving speed of a charged particle is fast.

POSSIBILITY OF INDUSTRIAL UTILIZATION

The magnetic resonance type accelerator in which the method of incidence according to the present invention is employed, can be applied to a light source of a SOR apparatus which is used in a X-ray exposure apparatus for micro-fine machining of super LSI's or the like.

What is claimed is:

1. A method of injecting charged particles from an incident orbit onto a central equilibrium orbit which is substantially circular in shape along a predetermined plane and which is defined by a principal magnetic field perpendicular to said predetermined plane, said method comprising the steps of:

providing said charged particles in said incident orbit generating, onto said predetermined plane, a non-linear magnetic field in superposition to said principal magnetic field so as to preliminarily modify said central equilibrium orbit into a resonant orbit so that said resonant orbit has horizontal betatron oscillations of a number substantially equal to one-half;

varying said resonant orbit with time by changing said non-linear magnetic field to thereby inject said charged particles from said incident orbit onto said central equilibrium orbit.

2. A method of injecting charged particles from an incident orbit onto a central equilibrium orbit which is substantially circular in shape along a predetermined plane and which is defined by a principal magnetic field perpendicular to said predetermined plane, said method comprising the steps of:

providing said charged particles in said incident orbit generating, onto said predetermined plane, a non-linear magnetic field in superposition to said principal magnetic field so as to preliminarily modify said central equilibrium orbit into a resonant orbit so that said resonant orbit has horizontal betatron oscillations of a number substantially equal to one-half; and, generating an additional magnetic field of a quadrupole onto said predetermined plane; and varying said resonant orbit with time by locally changing said additional magnetic field with said non-linear magnetic field statically kept unchanged width time to thereby inject said charged particles from said incident orbit onto said central equilibrium orbit.

3. A magnetic resonance type accelerator for use in injecting charged particles onto a central equilibrium orbit which is substantially circular in shape on a predetermined plane and which is defined by a principal magnetic field perpendicular to said predetermined plane, said accelerator comprising:

an inflector for guiding said charged particles onto an incidence orbit;

a first electro-magnet for generating a non-linear magnetic field of an octa-pole in superposition on said principal magnetic field to put the charged particles incident on said incidence orbit in a resonant orbit which has horizontal betatron oscillations of a number which is substantially equal to one-half; and a second electro-magnetic for generating a magnetic field of a quadrupole which is variable with time so that said resonant orbit is varied in accordance with a variation of said quadropole so as to inject said charged particles into said equilibrium orbit.

4. A magnetic resonance type accelerator for use in injecting charged particles onto a central equilibrium orbit which is substantially circular in shape on a predetermined plane and which is defined by a principal magnetic field perpendicular to said predetermined plane, said accelerator comprising:

an inflector for guiding said charged particles onto an incidence orbit;

a first electro-magnet for generating said principal magnetic field to provide said predetermined plane; and a second electro-magnet variable with time for generating a non-linear magnetic field of an octa-pole to form a resonant orbit which has betatron oscillations of a number substantially equal to one-half, to change said resonant orbit with time, and to thereby capture the charged particles on said central equilibrium orbit when the charged particles are put on said resonant orbit after incidence of said charged particles on said incident orbit.

* * * * *